US009138094B2

(12) United States Patent
Roth et al.

(10) Patent No.: US 9,138,094 B2
(45) Date of Patent: Sep. 22, 2015

(54) MAGNETIC CURTAIN ADAPTED FOR ATTACHMENT TO A MAGNETIC AND/OR A NON-MAGNETIC MATERIAL OR SURFACE

(71) Applicant: Lite-Away!, LLC, Royal Palm Beach, FL (US)

(72) Inventors: James Roth, West Palm Beach, FL (US); Mary E. Roth, West Palm Beach, FL (US)

(73) Assignee: Lite-Away!, LLC, Royal Palm Beach, FL (US)

( * ) Notice: Subject to any disclaimer, the term of this patent is extended or adjusted under 35 U.S.C. 154(b) by 70 days.

(21) Appl. No.: 14/205,233

(22) Filed: Mar. 11, 2014

(65) Prior Publication Data

US 2014/0251560 A1 Sep. 11, 2014

Related U.S. Application Data

(63) Continuation-in-part of application No. 13/672,084, filed on Nov. 8, 2012, now Pat. No. 8,689,852.

(60) Provisional application No. 61/556,905, filed on Nov. 8, 2011.

(51) Int. Cl.

| | |
|---|---|
| ***A47H 23/00*** | (2006.01) |
| ***A47H 1/18*** | (2006.01) |
| ***A47H 1/00*** | (2006.01) |
| *A47H 23/02* | (2006.01) |

(52) U.S. Cl.

CPC .. *A47H 1/18* (2013.01); *A47H 1/00* (2013.01); *A47H 23/00* (2013.01); *A47H 2023/025* (2013.01); *A47H 2201/01* (2013.01)

(58) Field of Classification Search

USPC ..... 160/327, 330, 368.1, 354, 105, 370.21, 160/349.1, 349.2, DIG. 16

IPC ..... A47H 23/00,2201/01

See application file for complete search history.

(56) References Cited

U.S. PATENT DOCUMENTS

| | | | |
|---|---|---|---|
| 2,212,326 | A | 8/1940 | Piken |
| 2,595,833 | A | 5/1952 | Flaherty |
| 2,948,407 | A | 8/1960 | Wiszuk |
| 3,000,016 | A | 9/1961 | Ridge |

(Continued)

OTHER PUBLICATIONS

Krautli, F., "Magnetic Curtain", Internet article, http://www.apartmenttherapy.com/magnetic-curtain-by-florian-kr-42152, (retrieved from the Internet Mar. 1, 2013).

(Continued)

*Primary Examiner* — David Purol

(74) *Attorney, Agent, or Firm* — McHale & Slavin, P.A.

(57) ABSTRACT

The present invention describes a window covering which is useful for securing to objects having windows without using permanent attachment devices. The window covering preferably contains a plurality of magnets arranged along the upper end and along the lower end. The magnets are arranged so that they are coupleable or securable to a metal part of a window itself or a metal surface which houses the window as well as one or more additional magnets positioned within the window covering. The window covering further comprises one or more non-magnetic surface adapters constructed and arranged to secure to at least one magnet along a first surface and to a second, non-magnetic surface along a second surface. The window covering provides at least one contact point for securing to at least one non-magnetic surface.

24 Claims, 13 Drawing Sheets

(56) References Cited

U.S. PATENT DOCUMENTS

| | | | | |
|---|---|---|---|---|
| 3,042,111 | A | 7/1962 | Wytovich | |
| 3,102,314 | A | 9/1963 | Alderfer | |
| 3,107,361 | A | 10/1963 | Glutting, Sr. | |
| 3,263,736 | A | 8/1966 | Macomson | |
| 3,282,328 | A | 11/1966 | Mushro et al. | |
| 3,365,684 | A | 1/1968 | Stemke et al. | |
| 3,679,505 | A | 7/1972 | Hinderaker et al. | |
| 3,805,872 | A | 4/1974 | Lorber | |
| 3,827,019 | A | 7/1974 | Serbu | |
| 4,139,233 | A | 2/1979 | Bott | |
| 4,391,865 | A | 7/1983 | Constance | |
| 4,397,346 | A | 8/1983 | Chumbley et al. | |
| 4,510,986 | A | 4/1985 | Schwankl | |
| 4,802,523 | A | 2/1989 | Scholten et al. | |
| 5,090,469 | A | 2/1992 | Boulanger | |
| 5,398,900 | A | 3/1995 | Schober | |
| 5,524,689 | A | 6/1996 | Clark | |
| D394,357 | S | 5/1998 | Mulder | |
| 5,911,266 | A | 6/1999 | Jacobs | |
| 5,918,417 | A | 7/1999 | Kinder | |
| D419,427 | S | 1/2000 | Mulder | |
| 6,155,523 | A | 12/2000 | Pitre | |
| 6,301,754 | B1 | 10/2001 | Grunberger et al. | |
| 6,772,815 | B1 | 8/2004 | Judkins | |
| 7,100,663 | B2 | 9/2006 | Zhang et al. | |
| 8,689,852 | B2 * | 4/2014 | Roth et al. | 160/327 |
| 2007/0144688 | A1 | 6/2007 | Grat | |
| 2012/0090796 | A1 | 4/2012 | D'Ambrosia | |

OTHER PUBLICATIONS

Anonymous, "Magic Mesh", Internet page, https://www.buymagicmesh.com/?tag=im|sm|go|gn&a_aid=011&a_bid=d330313e, (retrieved from the Internet Mar. 1, 2013).

* cited by examiner

MAGNETIC CURTAIN ADAPTED FOR ATTACHMENT TO A MAGNETIC AND/OR A NON-MAGNETIC MATERIAL OR SURFACE

REFERENCE TO RELATED APPLICATION

In accordance with 37 C.F.R 1.76, a claim of priority is included in an Application Data Sheet filed concurrently herewith. Accordingly, the present invention claims priority as a continuation-in-part of U.S. patent application Ser. No. 13/672,084 entitled "MAGNETIC CURTAIN", filed on Nov. 8, 2012, which claims priority of U.S. Provisional Patent Application No. 61/556,905 entitled "MAGNETIC CURTAIN", filed on Nov. 8, 2011. The contents of each of the above referenced applications are herein incorporated by reference in its entirety.

FIELD OF THE INVENTION

The present invention relates to window coverings, and more particularly to window covering devices useful for windows having or associated with metal and/or non-metal frames.

BACKGROUND OF THE INVENTION

Window coverings are a popular means of providing decoration and privacy. Window shades are the simplest and cheapest form of covering windows, and include a wound-up material that can be pulled down to cover a window and pulled up to allow light to pass through. In addition to providing decoration and privacy, window coverings have been designed to reduce heat absorption and/or to prevent heat dissipation. Window blinds are a common commercially used window covering. For example, Venetian blinds, such as those described in U.S. Pat. No. 6,772,815 or U.S. Pat. No. 7,100,633, include a plurality of horizontal slats positioned one above another and suspended by strips of cloth or cords. Another common type of window blind is the vertical blind. These blinds include vertical hanging materials, typically plastic, that rotate between open and closed configurations.

In addition to windows being placed within walls, it is common for doors to have windows as well. Door windows can be covered using window blinds or shades securable to the door. U.S. Pat. No. 5,918,417 describes a shutter assembly which is designed to install over an arched window. Arched-windows are commonly installed in both conventional rectangular windows and above doorways. Like all window coverings, arched-window coverings are designed to limit the amount of sunlight that passes through the window, provide privacy, limit the amount of heat produced from the sun, or reduce fading of carpeting or wood flooring. Typical window coverings require some type of mounting brackets to secure a curtain over a window. The arched window shutter described by the '417 patent also includes hardware to secure and stabilize the shutter. While such arrangement may provide for a relatively secure covering, it is disadvantageous because it permanently damages the door or wall near the window and prevents a user from quickly and easily replacing such coverings if desired.

U.S. Patent Application 2012/0090796 discloses a magnetic curtain of light interrupting material. The curtain is described as having a plurality of magnets positioned in its periphery with the magnets sized to magnetically adhere to the interior surface of a steel entrance door. While the '796 application describes a magnetic curtain, such embodiment is limited to magnets attached along the periphery.

SUMMARY OF THE INVENTION

The present invention describes a universal magnetic curtain window covering which will cover a window in a steel and or non-steel door without using permanent attachment devices such as curtain rods attached to the door with screws and mounting hardware. The window covering in accordance with the present invention contains a plurality of coupling members which allow the window covering to be arranged in multiple configurations, thereby allowing one or more portions of the window to be covered and/or uncovered at one time. The window covering preferably contains a plurality of magnets positioned along the upper end, preferably upper end corners, and along the lower end, preferably at the lower end corners. The magnets along the upper end are arranged so that they are coupleable or securable to a metal part of the window itself or a metal surface which houses the window, as well as one or more magnets positioned at the bottom end of the window covering. This arrangement allows the magnetic window covering to be attached to a steel object, such as a steel door, without the need for hanging hardware. In addition, the window covering contains non-magnetic surface adapters constructed and arranged to secure to at least one magnet along a first surface and a second, non-magnetic surface along a second surface. The window covering provides at least one contact point for securing to at least one non-magnetic surface.

Accordingly, it is an objective of the present invention to provide a window covering which can cover a window without the need for affixing structures, such as screws, hardware, or a curtain rod.

It is a further objective of the present invention to provide a magnetic window covering which can cover a window without the need for affixing structures, such as screws, hardware, or a curtain rod.

It is a further objective of the present invention to provide a magnetic window covering which can cover a window having or associated with magnetic and/or non-magnetic surfaces or materials without the need for affixing structures, such as screws, hardware, or a curtain rod.

It is yet another objective of the present invention to provide a magnetic window covering adapted to cover a window having or associated with magnetic and/or non-magnetic surfaces or materials which can be arranged in multiple configurations to cover one or more portions of a window without the need for affixing structures, such as screws, hardware, or a curtain rod.

It is a still further objective of the invention to provide a magnetic window covering adapted to cover a window having or associated with magnetic and/or non-magnetic surfaces or materials which allows the user the ability to quickly and easily decorate a window.

It is a further objective of the present invention to provide a magnetic window covering adapted to cover a window having or associated with magnetic and/or non-magnetic surfaces or materials which can be changed by the user, thereby providing window coverings with different shapes, sizes, and decorations.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
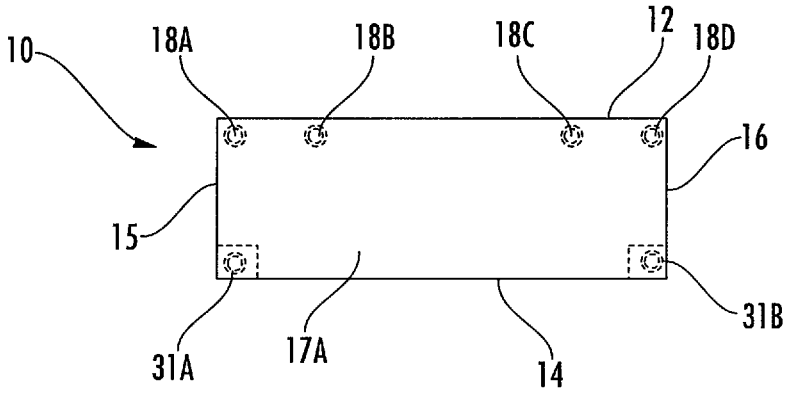
FIG. 1 illustrates a magnetic window covering adapted to attach to a magnetic and/or non-magnetic material or surface in accordance with the present invention.

While the present invention is susceptible of embodiments in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIG. 1, a magnetic curtain window covering adapted to attach to a magnetic and/or non-magnetic material or surface, referred to generally as magnetic curtain window covering 10, is shown. The magnetic curtain window covering 10 is shown having a generally rectangular shape, however, such shape is illustrative only. The magnetic curtain window covering 10 may be made of any known material including but not limited to fire proof material, materials that limit the amount of natural or artificial light or totally prevent light from traveling through, and may be solid or textured such as having a weave pattern. The magnetic curtain window covering 10 contains a first upper end 12 and a second lower end 14. Separating the first upper end 12 and the second lower end 14 are side ends 15 and 16. The magnetic curtain window covering 10 further contains a front surface 17A and a back surface 17B, see FIGS. 1 and 6. In a preferred embodiment, the magnetic window covering 10 is designed to couple to a metal door. Accordingly, the magnetic window covering 10 contains a plurality of attachment members, illustrated herein as magnetic members such as a permanent magnet. The plurality of magnets 18A-D, collectively referred to as 18, is placed at or near the upper end 12 and along the lower end 14 (see 31A and 31B). Each of the magnets 18 is orientated such that they not only bind to the door but also bind to each other.

Figure 2A:
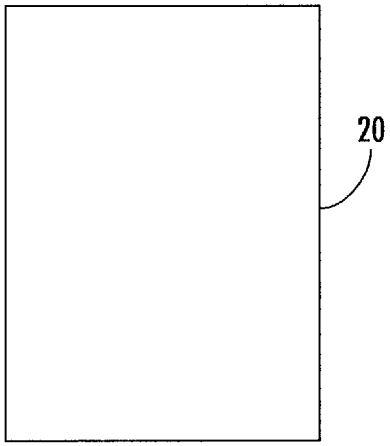
FIG. 2A illustrates the magnetic window covering adapted to attach to a magnetic and/or non-magnetic material or surface in its initial stage of construction, shown as a single sheet.
Figure 2B:
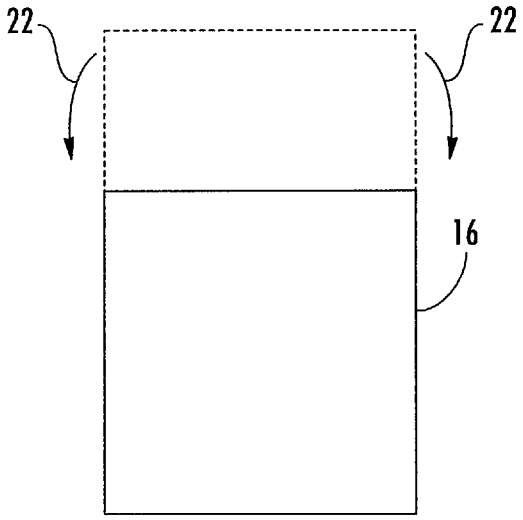
FIG. 2B illustrates the single sheet shown in FIG. 2A in a folded position.
Figure 3:
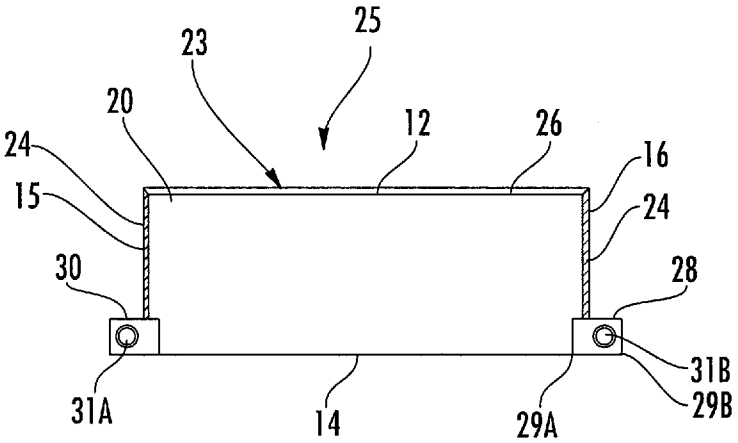
FIG. 3 illustrates the connection of two sewn pockets containing a magnet and positioned along the two bottom corners of the window covering.
Figure 4:
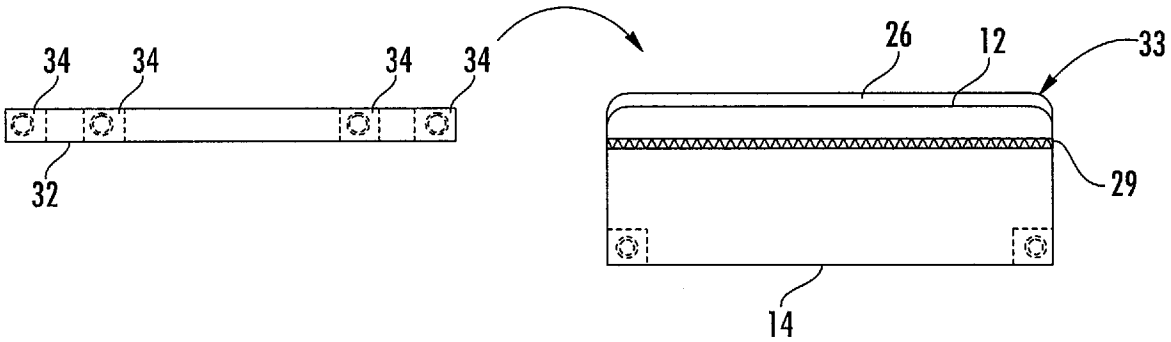
FIG. 4 illustrates the magnetic window covering adapted to attach to a magnetic and/or non-magnetic material or surface turned inside out and sealed along the upper edges to form an upper fastening member panel receiving area.
Figure 5:
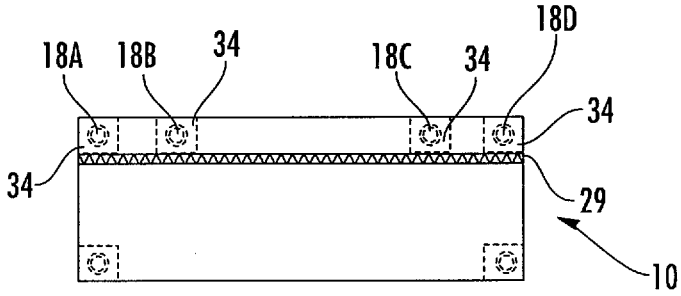
FIG. 5 illustrates a partially assembled magnetic window covering adapted to attach to a magnetic and/or non-magnetic material or surface in accordance with the present invention.

FIGS. 2-4 show an illustrative example of the magnetic window covering 10 being constructed. The magnetic window covering 10 is preferably constructed from a single sheet of material, generally referred to as 20, see FIG. 2A. The material may be fabrics, plastics, or other materials which are useful for covering a window. Additionally, the material may include decorative images, such as colored pattern or theme-based images, written words or phrases, or combinations thereof. The materials can be designed to prevent light from passing through or allow varying amounts of light to pass through. The single sheet 20 is folded in half, along the direction of arrows 22 to form the desired shape and size, see FIG. 2B. Once in the folded position, the sheet 20 can be sealed on each side to form side ends 15 and 16, and an interior portion 23, see FIG. 3.

Sealing of the sides can be accomplished through stitching 24, chemical fastening means, heat sealing, or other sealing means known to one of skill. The stitching along the side creates an enclosed, bag-like structure 25 having an open end 26. Two magnet holding members, 28, 30, illustrated herein as pouches, are attached to the second lower end 14 at each of the corners. In an illustrative example, the first end 29A of the pouch 28 is coupled to a portion of the magnetic window covering 10. A second end 29B remains uncoupled and extends into the interior portion 23. Pouch 30 may be constructed and secured in the same manner. Magnets 31A and 31B are placed inside each of the pouches 28 and 30 and sealed within. As shown in FIG. 3, the pouches are located on the outside of the bag-like structure 25. To place the pouches on the inside, the manufacturer simply turns the bag-like structure 25 inside out so that the pouches are located on the inside, as shown in FIG. 4. The pouches are preferably located at the bottom corners and extend within the interior of the magnetic window covering 10, which prevents winds from flipping the magnetic window covering 10 over the top of the door. A longitudinal stitching 29 is placed near the first upper end 12 to seal the bag-like structure 25 at a predetermined position. A portion of the upper end maintains the opening 26. The longitudinal stitching 29 creates a third pouch or channel 33 which is sized and shaped to receive a magnet holding member 32. Preferably, the third pouch or channel 33 is formed within the interior portion 23. Alternatively, the magnetic window covering 10 can be made of two pieces of fabric material and secured together along the periphery. Formation of the third pouch or channel 33, as well as use of the pouches 28 and 30, may be utilized in this construction as well.

The magnet holding member 32 is sized and shaped to fit within the third pouch or channel 33 to provide connection capability along the upper end 12 to a metal surface. The magnetic holding member 32 and the magnetic window covering 10 may be constructed of a different material. Alternatively, the magnetic holding member 32 may be of the same material as the magnetic window covering 10. Preferably, the magnetic holding member 32 is made from a rigid material, such as pleading material. The rigid nature of the material fixes the magnets in place, as well as helps retain the overall shape. Additionally, the magnet holding member 32 may be constructed of a semi-rigid or flexible material. The magnets 18 may be secured to the magnet holding device 32 by any means known to one of skill in the art, including chemical means or stitching. In a preferred manner, the magnets 18 are placed in a plurality of pockets 34. The magnets 18 may be equally spaced apart, but need not be. The magnet holding member 32 is placed into the third pouch or channel 33 and sealed, thereby forming the magnetic window covering 10. Use of the magnet holding member 32 provides a mechanism to secure magnets within the body of the magnetic window covering 10, i.e. within the interior portion 23, as the magnet holding member 32 positions one or more magnets therein, i.e. longitudinally from, for example, side 15 to side 16.

Figure 6:
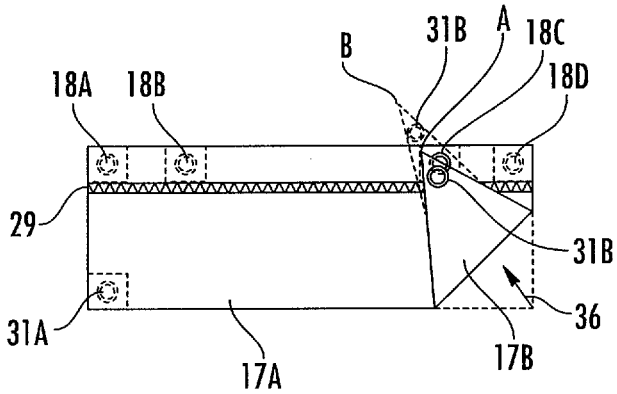
FIG. 6 illustrates the partially assembled magnetic window covering adapted to attach to a magnetic and/or non-magnetic material or surface in accordance with the present invention and shown with the bottom edge secured to a portion of the upper edge.
Figure 7:
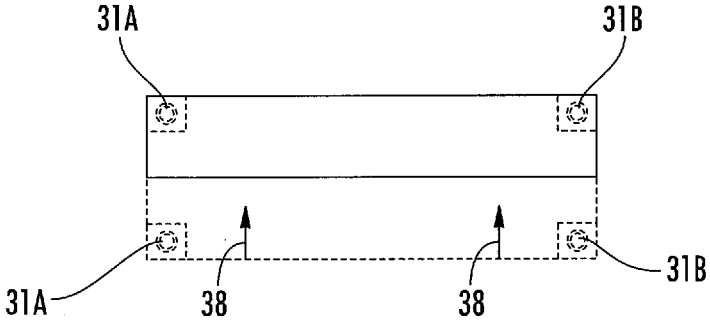
FIG. 7 illustrates the partially assembled magnetic window covering adapted to attach to a magnetic and/or non-magnetic material or surface in accordance with the present invention and shown with the lower portion secured to the upper portion.

The unique design of the magnetic window covering 10 allows the user the capability to couple the magnets 31A and 31B positioned at each of the corners to one or more of the magnets 18 located along the upper end 12, as well as a metal frame. Referring to FIG. 6, the lower right corner is shown lifted and moved in the direction of arrow 36. Moving the lower corner in such direction allows the magnet 31B to engage and connect with magnet 18C located along the upper end 12, see position A. Alternatively, the lower right corner could secure to a portion of the door represented by position B. Similarly, the entire lower end 14 of the magnetic window covering 10 may be lifted upwardly toward the upper end 12, see arrows 38 on FIG. 7, so that magnet 31A couples to magnet 18A and magnet 31B couples to magnet 18D, or secures to portions of the metal door. Additionally, the unique design of the magnetic window covering 10 allows the user to attach the window covering 10 to a metal door frame to cover a window within the door without the need for affixing permanent attachment structures to the door, thereby eliminating the need to alter the structure of the door or create permanent holes within.

Figure 8:
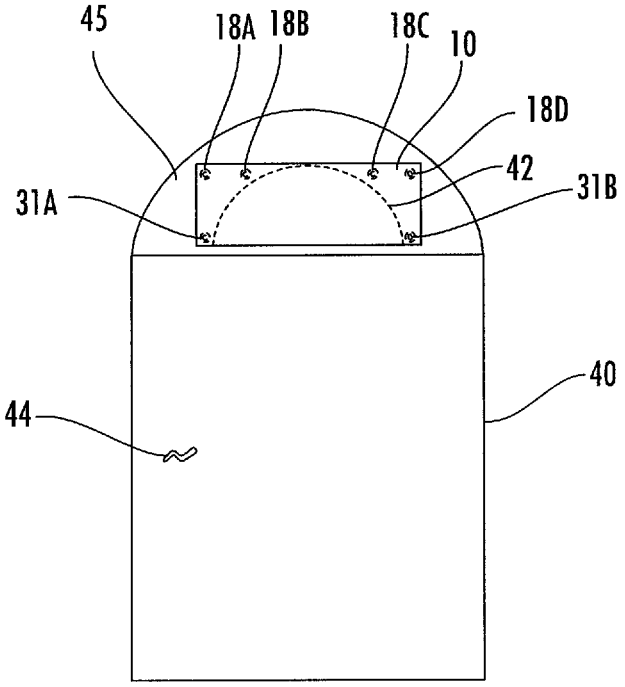
FIG. 8 illustrates the partially assembled magnetic window covering adapted to attach to a magnetic and/or non-magnetic material or surface in accordance with the present invention positioned over a semi-circular window located in a metal door.
Figure 9:
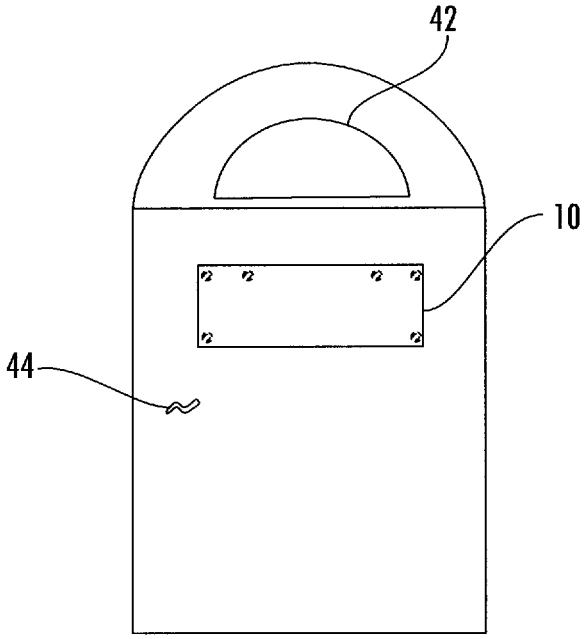
FIG. 9 illustrates the partially assembled magnetic window covering adapted to attach to a magnetic and/or non-magnetic material or surface in accordance with the present invention secured to the metal door below the semi-circular window.
Figure 10:
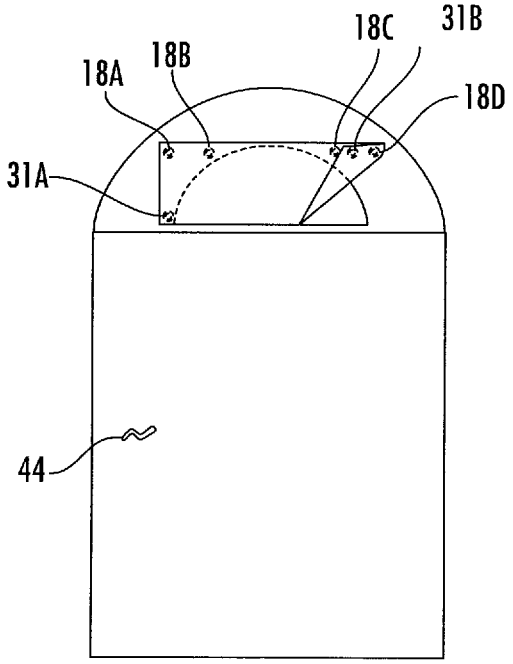
FIG. 10 illustrates the partially assembled magnetic window covering adapted to attach to a magnetic and/or non-magnetic material or surface exemplified in FIG. 8 and shown with a bottom edge secured to a portion of the upper edge and/or the metal door, thereby revealing a portion of the window.

Referring to FIG. 8, an illustrative example of a door 40 is shown. The door 40 contains a semi-circular shaped window 42 located at or near the top of the door and a handle 44. Coupled or secured to the semi-circular shaped window 42 is the magnetic window covering 10. The magnetic window covering 10 is secured to the door 42 through magnets 18, 31A, and 31B contacting a metal surface 45 of the door 40. In this position, the magnetic window covering 10 completely covers the window. Depending on the material used, this prevents all or some of the light from traveling through the window, and may prevent others from looking in/out through the window 42. In an illustrative example, the material is selected to exhibit light diffusing properties so as to allow soft light to enter into an area. This provides for prevention of harsh sun glare and results in protection of objects such as paintings or photos from fading as a result of the harsh sunlight. As demonstrated in FIGS. 6 and 7, portions of the magnetic window covering 10 may be manipulated to allow various portions of the magnetic window covering 10 to be lifted and coupled to other parts of the magnetic window covering 10. Alternatively, portions of the magnetic window covering 10 may be manipulated to secure to the metal portion of the door. Referring to FIG. 9, the magnetic window covering 10 is shown removed from the semi-circular shaped window 42 and secured to the door 40. The magnetic curtain window covering 10 may remain in such position where it continually hangs until covering of the window is required. As shown in FIG. 10, the bottom right portion of the magnetic curtain window covering 10 is lifted so that magnet 31B couples to magnet 18C or to a portion of the door 40. As the magnet 31B is secured to magnet 18C or the portion of the door 40, a portion of the window 42 is exposed and is no longer covered by the magnetic curtain window covering 10. It is understood that the magnetic curtain window covering 10 can be arranged in multiple positions so that various portions of window 42 can be exposed and/or covered simultaneously through lifting and repositioning of one or more portions of the magnetic curtain window covering 10. The flexibility that the window covering 10 provides allows the user the ability to quickly and easily decorate a door window by using window coverings 10 having different shapes, colors, and/or decorations. Additionally, the magnetic curtain window covering 10 allows a user the ability to cover or uncover the window quickly and easily.

The magnetic curtain window covering 10 is preferably adapted to be capable of securing to or coupling to magnetic surfaces or materials, non-magnetic surfaces or materials, or combinations there of. Such capability expands the use of the magnetic curtain window covering 10 and does not confine using with windows having or associated with steel frames. Accordingly, magnetic curtain window covering 10 is designed to contain one or more non-magnetic surface adapters 46A, 46B, 46C, 46D, 46E, 46F, referred to generally as 46. Each of the non-magnetic surface adapters 46 are designed to couple to the magnets at one surface and provide a second surface which can couple or secure to an independent, non-metallic, non-magnetic surface, such as a wood or plastic door or window frame.

Figure 11:
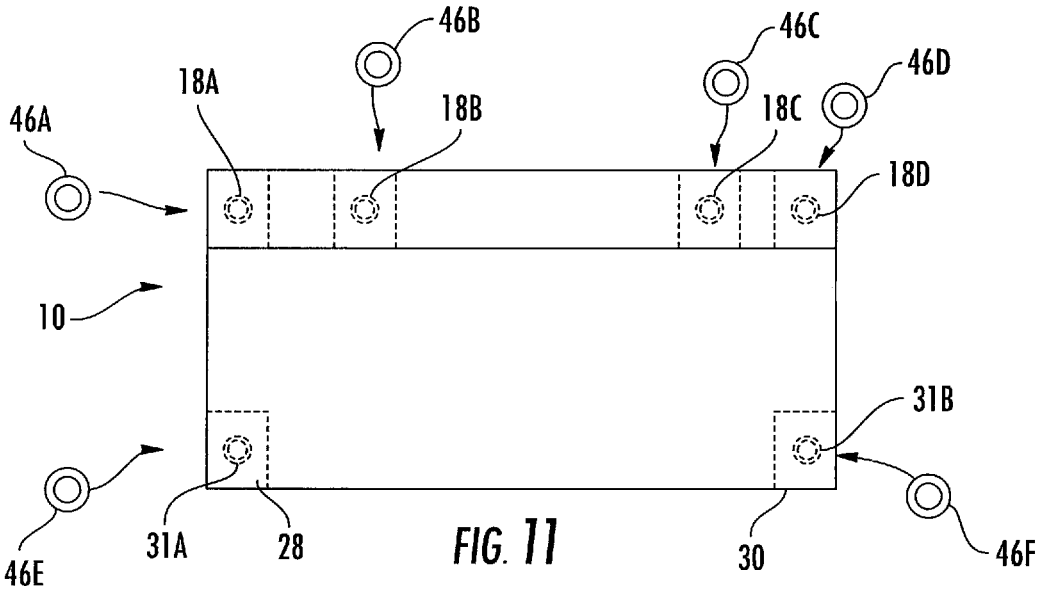
FIG. 11 illustrates the coupling of a plurality of non-magnetic surface adapters to the magnetic window covering adapted to attach to a magnetic and/or non-magnetic material or surface.
Figure 12:
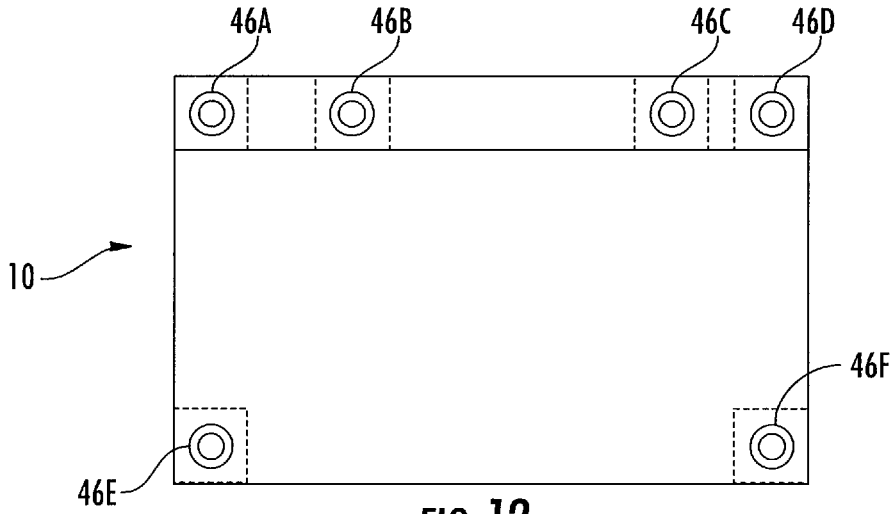
FIG. 12 illustrates the magnetic window covering adapted to attach to a magnetic and/or non-magnetic material or surface with non-magnetic surface adapters covering all magnets.
Figure 13:
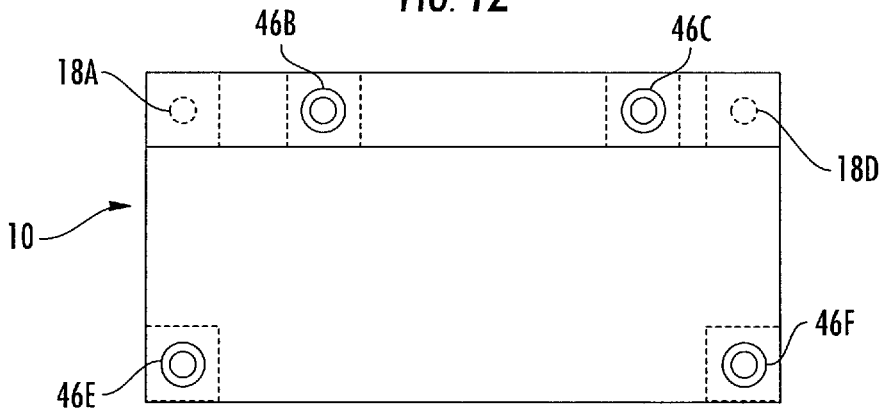
FIG. 13 illustrates the magnetic window covering adapted to attach to a magnetic and/or non-magnetic material or surface having non-magnetic surface adapters covering less than all magnets.

As shown in FIGS. 11 and 12, the magnetic curtain window covering 10 contains one or more non-magnetic surface adapters 46A, 46B, 46C, 46D, 46E, 46F are shown coupled to, or secured to magnets 18A-D and magnets 31A and 31B are placed inside each of the pouches 28 and 30. While FIG. 12 illustrates each magnet being coupled to a non-magnetic surface adapter, the magnetic curtain window covering 10 may be designed so that at least one magnet, in this case two magnets 18A and 18D, are not coupled to non-magnetic surface adapters 46, see FIG. 13. In this configuration, the magnetic curtain window covering 10 can be secured, or coupled to objects made from different materials, including a magnetic surface or material and a non-magnetic surface or material.

Figure 14:
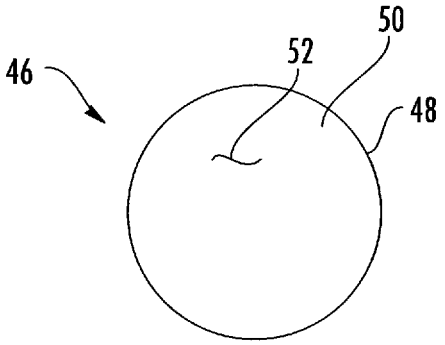
FIG. 14 is a front view of an illustrative example of a non-magnetic surface adapter.
Figure 15:
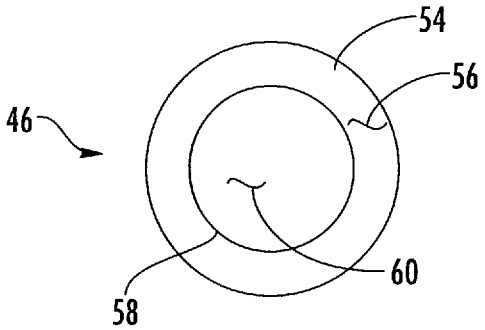
FIG. 15 is a back view of the non-magnetic surface adapter illustrated in FIG. 14.
Figure 16:
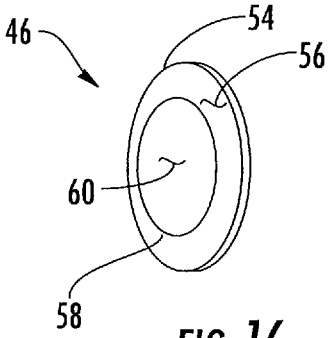
FIG. 16 is a side perspective view of the non-magnetic surface adapter illustrated in FIG. 11.

Referring to FIGS. 14-16, an illustrative example of the non-magnetic surface adapter 46 is shown. The non-magnetic surface adapter 46 comprises a body, illustrated herein as a circular body 48. The circular body 48 comprises a first side having a first surface 52 and an opposing second side 54 having a second surface 56. The first surface 52 and the second surface 56 are designed to couple to different materials or surfaces thereby providing a mechanism in which the magnetic curtain window covering 10 is secured or coupleable to a variety of surfaces. As an illustrative example, the circular body 48 may be made of a magnetic material so that first surface 52 is magnetically coupleable to magnets 18A-18D and/or to magnets 31A and 31B. The second surface 56 may be made of a material that is non-magnetic and also adhesive. Alternatively, the second surface 56 may also be made of a magnetic material but contain one or more adhesion members attached thereto.

As shown in FIGS. 15 and 16, the adhesion member is illustrated as an adhesive material 58 having an adhesive surface 60. The adhesive material 58 can be, for example, a chemical composition, such as a liquid adhesive, or may be one member of a loop and hook fastener, such as VELCRO. Preferably, the adhesive material 58 is a repositionable adhesive or putty, such as BLUE STICK adhesive, GLUE DOT Adhesives, SCOTCH adhesive dots, or SCOTCH removable mounting squares. The adhesive material may be covered by a protective sheet (not shown) which the user peels away prior to securing to the independent surface. Whatever material the adhesion member is made of, it must allow coupling, binding or securing to a surface or a material that is non-magnetic, such as, but not limited to wood, plastic, concrete, tile, aluminum, and fiberglass. The portion of the opposing second side 54 not covered by the adhesive member may be magnetic so as to allow for coupling to another magnet within the magnetic curtain window covering 10, similar to the backward folding shown in FIG. 6.

Figure 17:
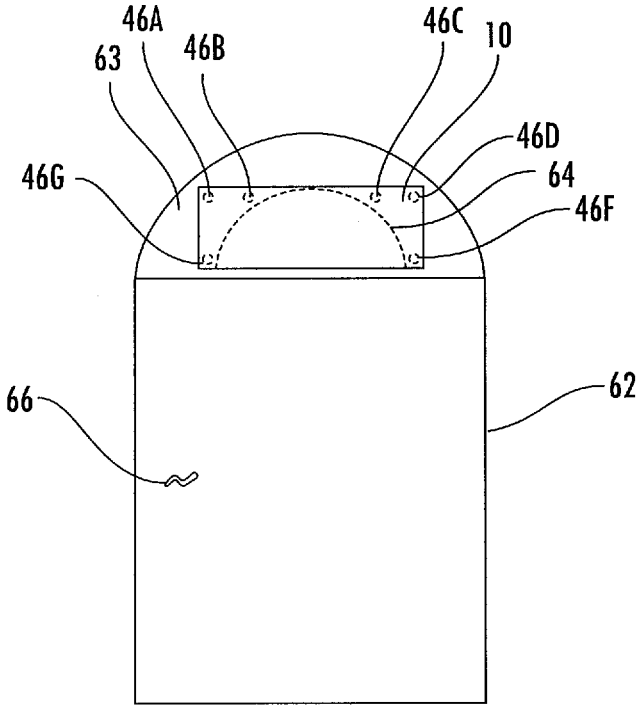
FIG. 17 illustrates the partially assembled magnetic window covering adapted to attach to a magnetic and/or non-magnetic material or surface in accordance with the present invention positioned over a semi-circular window located on a non-metal surface of a door.
Figure 18:
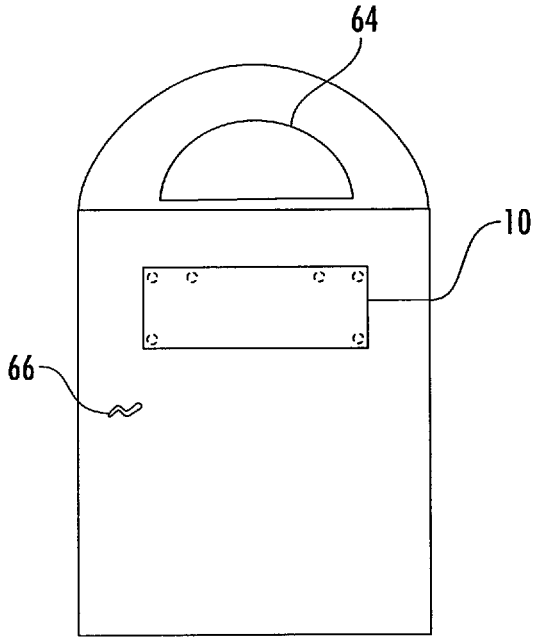
FIG. 18 illustrates the partially assembled magnetic window covering adapted to attach to a magnetic and/or non-magnetic material or surface in accordance with the present invention secured to the non-metal surface below the semi-circular window.
Figure 19:
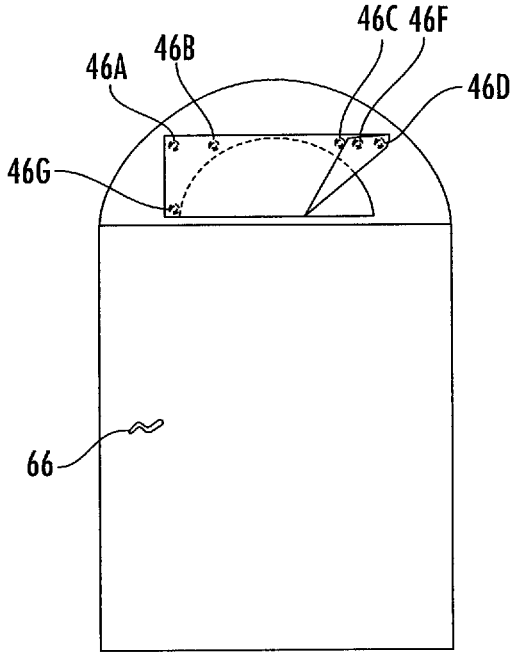
FIG. 19 illustrates the partially assembled magnetic window covering adapted to attach to a magnetic and/or non-magnetic material or surface exemplified in FIG. 17 and shown with a bottom edge secured to a portion of the upper edge and/or the door, thereby revealing a portion of the window.

Referring to FIG. 17, an illustrative example of a door 62 having non-metallic surfaces 63 is shown. The door 62 contains a semi-circular shaped window 64 located at or near the top of the door and a handle 66. Coupled or secured to the semi-circular shaped window 64 is the magnetic window covering 10. The magnetic window covering 10 is secured to the door 62 through non-magnetic surface adapter 46A, 46B, 46C, 46D, 46E, 46F, contacting a non-metal surface 63 of the door 62. In this position, the magnetic window covering 10 completely covers the window. Depending on the material used, this prevents all or some of the light from traveling through the window, and may prevent others from looking in/out through the window 64. In an illustrative example, the material is selected to exhibit light diffusing properties so as to allow soft light to enter into an area. This provides for prevention of harsh sun glare and results in protection of objects such as paintings or photos from fading as a result of the harsh sunlight. As demonstrated previously, portions of the magnetic window covering 10 may be manipulated to allow various portions of the magnetic window covering 10 to be lifted and coupled to other parts of the magnetic window covering 10. Alternatively, portions of the magnetic window covering 10 may be manipulated to secure to the other non-metal portions of the door. Referring to FIG. 18, the magnetic window covering 10 is shown removed from the semi-circular shaped window 64 and secured to the door 62. The magnetic curtain window covering 10 may remain in such position where it continually hangs until covering of the window is required. As shown in FIG. 19, the bottom right portion of the magnetic curtain window covering 10 is lifted so that non-magnetic surface adapter 46F couples to magnet 18C, to non-magnetic surface adapter 46C, or to a portion of the door 62. As the non-magnetic surface adapter is secured to magnet 18C, non-magnetic surface adapter 46C, or the portion of the door 62, a portion of the window 64 is exposed and is no longer covered by the magnetic curtain window covering 10. It is understood that the magnetic curtain window covering 10 can be arranged in multiple positions so that various portions of window 64 can be exposed and/or covered simultaneously through lifting and repositioning of one or more portions of the magnetic curtain window covering 10. The flexibility that the window covering 10 provides allows the user the ability to quickly and easily decorate a door window by using window coverings 10 having different shapes, colors, and/or decorations. Additionally, the magnetic curtain window covering 10 allows a user the ability to cover or uncover the window quickly and easily.

Figure 20:
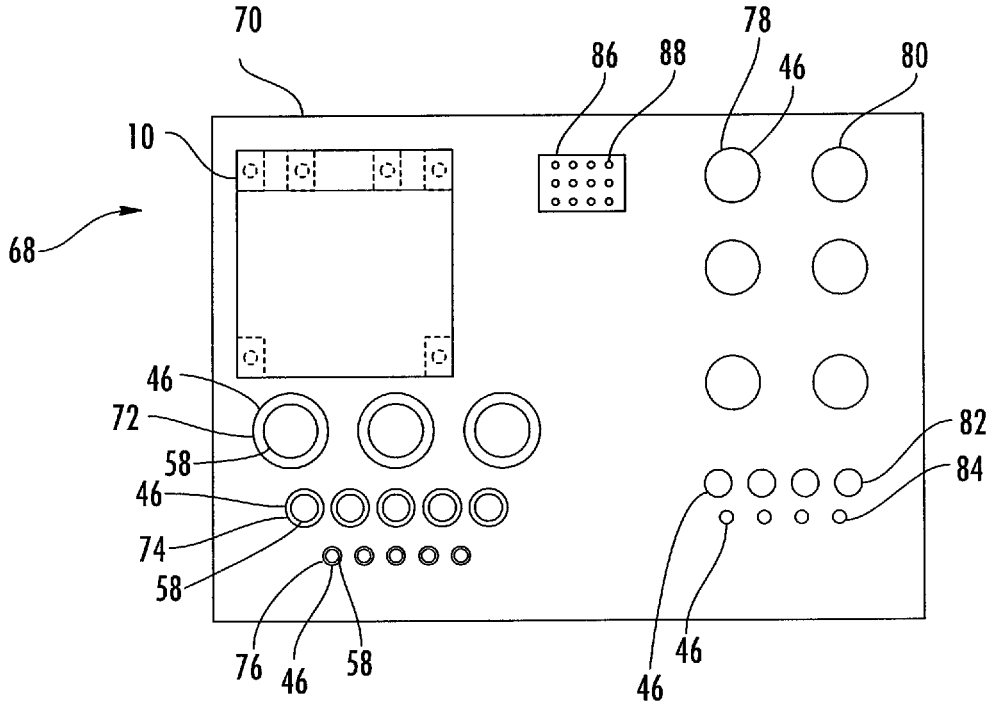
FIG. 20 is an illustrative example of a kit in accordance with the present invention.

The magnetic curtain window covering 10 may be provided in a kit, referred to generally as 68, to allow the user the ability to customize it use and/or replace one or more non-magnetic surface adapters 46. Referring to FIG. 20, a magnetic curtain window covering 10 without the non-magnetic surface adapter 46 secured thereto is enclosed in a container 70. While only one magnetic curtain window covering 10 is illustrated, the kit 68 may include a plurality of similar shaped coverings, different shaped coverings, or combinations thereof. To aid in allowing for adhesion to non-metallic surfaces, the kit 68 includes a plurality of non-magnetic surface adapter, including those having the same diameter, different diameters, or combinations thereof. The non-magnetic surface adapters included within kit 68 may have different characteristics as well, including, but not limited to, the type of magnetic connection and the strength of such connection. The kit 68 therefore may include a plurality of non-magnetic surface adapters 46 with adhesive attached thereto. The kit 68 may include a plurality of large sized non-magnetic surface adapters with adhesive, see row 72, medium sized non-magnetic surface adapters with adhesive, see row 74, or small sized non-magnetic surface adapters with adhesive, see row 76. Alternatively, or in addition to, the kit 68 may include one or a plurality of non-magnetic surface adapters 46 without adhesive. The kit 68 may include a plurality of large sized non-magnetic surface adapters without adhesive, see rows 78, 80, medium sized non-magnetic surface adapters without adhesive, see row 82, or small sized non-magnetic surface adapters without adhesive, see row 84. A package 86 having adhesive material 88 is included to allow the user to create non-magnetic surface adapters 46 with adhesive and/or replace an adhesive that no longer sticks to a surface.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An attachable, universal curtain for attachment to a frame having a window therein comprising:

a material having a predetermined shape to form a universal curtain, said universal curtain having a top end, a bottom end, a first side, and a second side;

at least one channel formed within said material, said channel extending longitudinally from said first end to said second end, said channel sized and shaped to receive a magnet holding member;

at least one magnet holding member;

at least one magnet, said at least one magnet coupled to said magnet holding member; and at least one non-magnetic surface adapter constructed and arranged to secure to said at least one magnet along a first surface and a second, non-magnetic surface along a second surface, thereby providing at least one contact point for securing said universal curtain to at least one non-magnetic surface.

2. The attachable, universal curtain for attachment to a frame having a window therein according to claim 1 whereby said at least one non-magnetic surface adapter has at least one magnetic surface for securing to said at least one magnet and at least one non-magnetic surface for securing to a non-magnetic surface.

3. The attachable, universal curtain for attachment to a frame having a window therein according to claim 2 wherein said at least one non-magnetic surface is a repositionable adhesive material.

4. The attachable, universal curtain for attachment to a frame having a window therein according to claim 1 further including at least one second magnet holding member attached along a portion of said bottom end.

5. The attachable, universal curtain for attachment to a frame having a window therein according to claim 3 wherein said magnet holding member contains a plurality of equally spaced magnets.

6. The attachable, universal curtain for attachment to a frame having a window therein according to claim 1 wherein said fabric contains an image.

7. A universal curtain for covering a window contained within a structure having a metal or non-metal frame comprising:

a magnetic curtain formed from a fabric material, said curtain having a front surface and a back surface, said front surface secured to said back surface to form an interior portion there between;

a channel formed within said interior portion of said curtain, said channel extending longitudinally from a first end of said curtain to a second end, said channel sized and shaped to receive a magnet holding member;

a first magnet holding member sized and shaped to extend longitudinally within said magnetic curtain from said first end to said second end;

at least one first magnet coupled to said magnet holding member;

a first magnet holding pouch sized and shaped to hold a second magnet, said first magnet holding pouch coupled to said fabric material along a first end, a second end extending within said interior portion of said curtain;

at least one second magnet secured within said first magnet holding pouch;

a second magnet holding pouch sized and shaped to hold a magnet, said second magnet holding pouch coupled to an opposing side of said fabric material along a first end, a second end extending within said interior portion of said curtain;

at least one third magnet secured within said second magnet holding pouch; and at least one non-magnetic surface adapter having a first magnetic surface for coupling to at least one first, second, or third magnet, and a second surface for coupling to at least one independent non-magnetic surface, thereby providing at least one contact point for securing said universal curtain to at least one non-magnetic surface.

8. The universal curtain for covering a window contained within a structure having a metal or non-metal frame according to claim 7 wherein said second surface of said non-magnetic surface adapter contains adhesive material.

9. The universal curtain for covering a window contained within a structure having a metal or non-metal frame according to claim 8 wherein said adhesive material is a repositionable adhesive.

10. The universal curtain for covering a window contained within a structure having a metal or non-metal frame according to claim 7 wherein said first surface and said second surface are coupled together using stitching.

11. The universal curtain for covering a window contained within a structure having a metal or non-metal frame according to claim 7 wherein said first surface and said second surface are coupled together using chemical fastening.

12. The universal curtain for covering a window contained within a structure having a metal or non-metal frame according to claim 7 wherein said first surface and said second surface are coupled together using heat sealing.

13. The universal curtain for covering a window contained within a structure having a metal or non-metal frame according to claim 7 wherein said first surface, said second surface, or combinations thereof contain an image, printed words, or combinations thereof.

14. The universal curtain for covering a window contained within a structure having a metal or non-metal frame according to claim 7 wherein said magnet holding member is made from a strip of material.

15. The universal curtain for covering a window contained within a structure having a metal or non-metal frame according to claim 14 wherein said strip of material contains a plurality of equally spaced magnets secured thereto.

16. The universal curtain for covering a window contained within a structure having a metal or non-metal frame according to claim 14 wherein said magnet holding member contains a plurality of pockets, each said pocket having a magnet positioned therein.

17. The universal curtain for covering a window contained within a structure having a metal or non-metal frame according to claim 7 wherein said fabric is a woven fabric.

18. The universal curtain for covering a window contained within a structure having a metal or non-metal frame according to claim 7 wherein said curtain is formed from a single sheet of fabric material folded in half to form said first surface and said second surface.

19. A kit containing a universal curtain for covering a window contained within a structure having a metal or non-metal frame comprising:

a universal curtain for attachment to a frame having a window therein comprising a material having a predetermined shape to form a universal curtain, said universal curtain having a top end, a bottom end, a first side, and a second side; at least one channel formed within said material, said channel extending longitudinally from said first end to said second end, said channel sized and shaped to receive a magnet holding member; at least one magnet holding member; and at least one magnet; said at least one magnet coupled to said first magnet holding member; and at least one non-magnetic surface adapter having a first magnetic surface for coupling to at least one first, second, or third magnet, and a second surface for coupling to at least one independent non-magnetic surface, thereby providing at least one contact point for securing said universal curtain to at least one non-magnetic surface.

20. The kit containing a universal curtain for covering a window contained within a structure having a metal or non-metal frame according to claim 19 wherein said at least one non-magnetic surface adapter comprises a second surface for coupling to at least one independent non-magnetic surface having an adhesive material.

21. The kit containing a universal curtain for covering a window contained within a structure having a metal or non-metal frame according to claim 19 further including a plurality of non-magnetic surface adapter having the same size, different sizes, or combinations thereof.

22. The kit containing a universal curtain for covering a window contained within a structure having a metal or non-metal frame according to claim 21 further including a plurality of non-magnetic surface adapter having the same size, different sizes, or combinations thereof.

23. The kit containing a universal curtain for covering a window contained within a structure having a metal or non-metal frame according to claim 19 further including adhesive material.

24. The kit containing a universal curtain for covering a window contained within a structure having a metal or non-metal frame according to claim 22 wherein said adhesive material is a repositionable adhesive.

* * * * *